US005103239A

United States Patent [19]

Verzemnieks et al.

[11] Patent Number: 5,103,239

[45] Date of Patent: Apr. 7, 1992

[54] SILICON NITRIDE ARTICLES WITH CONTROLLED MULTI-DENSITY REGIONS

[75] Inventors: Juris Verzemnieks, Tacoma; Fredrick H. Simpson, Seattle, both of Wash.

[73] Assignee: The United States of America as represented by the Secretary of the Air Force, Washington, D.C.

[21] Appl. No.: 898,071

[22] Filed: Aug. 20, 1986

[51] Int. Cl.[5] ..... H01Q 1/42

[52] U.S. Cl. ..... 343/872; 343/873; 343/705; 343/708

[58] Field of Search ..... 343/872, 873, 705, 708; 264/29.5, 43, 44, 60, 63

[56] References Cited

U.S. PATENT DOCUMENTS

| | | | |
|---|---|---|---|
| 4,177,230 | 12/1979 | Mazdiyasni | 264/60 |
| 4,358,772 | 11/1982 | Leggett | 343/872 |
| 4,388.255 | 6/1983 | Simpson | 264/29.1 |
| 4,520,364 | 5/1985 | Perry | 343/872 |
| 4,642,299 | 2/1987 | Hsieh | 343/872 |
| 4,677.443 | 6/1987 | Koetje et al. | 343/872 |

*Primary Examiner*—William L. Sikes
*Assistant Examiner*—Hoanganh Le
*Attorney, Agent, or Firm*—Donald J. Singer; Charles E. Bricker

[57] ABSTRACT

A monolithic silicon nitride radome structure having a forward portion, an after portion and a transition portion therebetween, is provided. The forward portion has a density of about 0.75 to 1.0 g/cc, the after portion has a density of about 1.6 to 2.0 g/cc and the transition portion has regions of increasing density, from forward to aft, each region having a greater density than the preceding portion or region. Also provided is a method for manufacturing the above-described radome structure which comprises filling and compacting a series of formulations consisting essentially of particulate silicon, silicon nitride and a fugitive pore-forming material into a radome mold, removing the shaped compact from the mold, subliming the pore-forming material from the compact to form a porous compact structure, and reacting the porous structure with nitrogen to convert the porous structure to an identically shaped radome structure of α-silicon nitride whiskers.

16 Claims, 1 Drawing Sheet

SILICON NITRIDE ARTICLES WITH CONTROLLED MULTI-DENSITY REGIONS

RIGHTS OF THE GOVERNMENT

The invention described herein may be manufactured and used by or for the Government of the United States for all governmental purposes without the payment of any royalty.

BACKGROUND OF THE INVENTION

This invention relates to ceramic broadband radomes, and in particular to a monolithic silicon nitride radome.

In various types of aircraft and missiles carrying radar equipment, an antenna is mounted in the nose of the craft and is covered with a suitable aerodynamic surface or radome. The radome must be constructed of material which is strong enough to withstand the aerodynamic forces to which it may be submitted, yet must be relatively distortion-free and highly transparent to radar energy.

Ceramic radomes appear to offer the best combination of low weight, high temperature strength, electromagnetic transmissibility, and thermal insulation, particularly for missiles encountering boundary layer temperatures over about 400° C. Ceramic materials with dielectric properties suitable for use as solid wall radomes are generally limited to silicon nitride, alumina, silica, mullite and beryllia. None of these materials, with the required dielectric constant of less than 10.0 and loss tangent of less than 0.01, has heretofore met the criteria of high transmission efficiency, rain erosion, and thermal stress resistance which are required of a radome for protection of antennas operating over a broad frequency range, when fabricated as a monolithic wall structure.

Low density silicon nitride appears attractive as a monolithic radome material. However, such low density material lacks the mechanical properties necessary for attaching the rear portion of the radome to a desired structure. Perry, U.S. Pat. No. 4,520,364, discloses a composite transition section interposed between a monolithic ceramic radome and a metal airframe. The transition section is adhesively bonded to the radome shell and bolted to the metal airframe. What is desired, however is a monolithic ceramic radome which has the desired electrical properties together with mechanical properties for adequate load transfer for attachment purposes.

Accordingly, it is an object of the present invention to provide a monolithic silicon nitride radome structure.

Another object of the present invention is to provide a method for fabricating a monolithic silicon nitride radome.

Other objects and advantages of the present invention will become apparent to those skilled in the art from consideration of the following description of the invention.

SUMMARY OF THE INVENTION

In accordance with the present invention there is provided a monolithic silicon nitride radome structure having a forward portion, an after portion and a transition portion therebetween, wherein the forward position has a density of about 0.75 to 1.0 g/cc, the after portion has a density of about 1.6 to 2.0 g/cc and the transition portion consists of a plurality of regions from forward to aft, each region having increasing density between the densities of the forward and after portions.

Also in accordance with the present invention there is provided a method for manufacturing a silicon nitride nosecone as described above, which comprises the steps of providing a radome mold having male and female mold portions providing a series of formulations consisting essentially of particulate silicon, silicon nitride and a fugitive pore-forming material, wherein a first one of the formulations contains first amount of the pore-forming material, a last one of the formulations contains a last amount of the pore-forming material and the series of formulations between the first and last formulations contain amounts of the pore-forming material between the first amount and the last amount; filling about 50 to 75% of the mold cavity with the first formulation, filling a portion of the remaining cavity with a next one of the formulations, which formulation contains less of the pore-forming material than the next preceding formulation, and repeating this step as desired; filling the remaining cavity with the last formulation; removing the resulting molded structure from the mold; subliming the pore-forming material from the molded structure to provide a porous molded structure; and reacting the porous molded structure with nitrogen to convert the structure to an identically shaped porous structure of α-silicon nitride whiskers.

BRIEF DESCRIPTION OF THE DRAWINGS

In the drawing,

FIG. 1 is a side elevation, partly in longitudinal section, of a radome attached to a metal airframe; and.

DETAILED DESCRIPTION OF THE INVENTION

Figure 1:
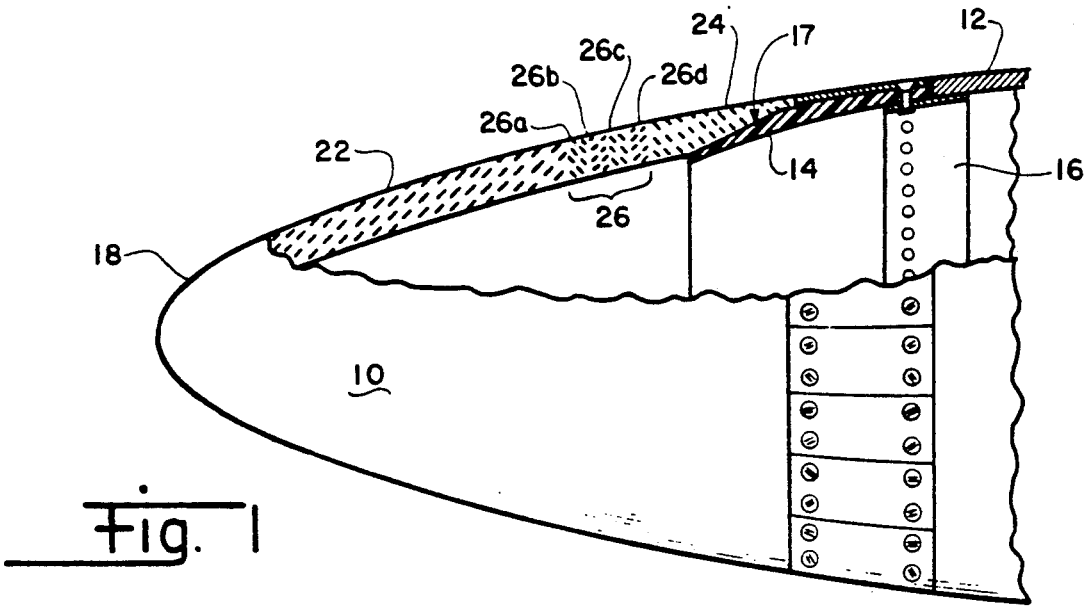

Referring to the drawing FIG. 1 illustrates a silicon nitride nosecone 10 attached to an airframe nose 12 through an a transition section 14 one portion of which is attached to airframe nose 12 in suitable manner, such as by bolting to a noseflange 16. The forward portion of transition section 14 is bonded to the nosecone 10, as indicated at 17. Further details of the transition section 14 are given in Perry, U.S. Pat. No. 4,520,364, which is incorporated herein by reference.

Nosecone 10 has a forward end 18, an after end 20, a forward portion 22, an after portion 24, and a transition portion 26. The forward portion 22 is porous silicon nitride having a density in the approximate range of 0.75 to 1.0 g/cc. The after portion 24 is porous silicon nitride having a density in the approximate range of 1.6 to 2.0 g/cc. The transition portion 26 consists of a plurality of regions of porous silicon nitride, each region having a density greater than the next preceding region or portion and less than the next succeeding region or portion, from front to aft. FIG. 1 illustrates four such regions, *26a–26d*. As an example, each of the portions and regions shown in FIG. 1 could have the densities shown below:

| | Density, g/cc |
|---|---|
| Forward portion 22 | 0.9 |
| Transition portion 26, | |
| region 26a | 1.0 |
| region 26b | 1.2 |
| region 26c | 1.4 |
| region 26d | 1.6 |

-continued

| | Density, g/cc |
|---|---|
| After portion 24 | 1.8 |

Figure 2:
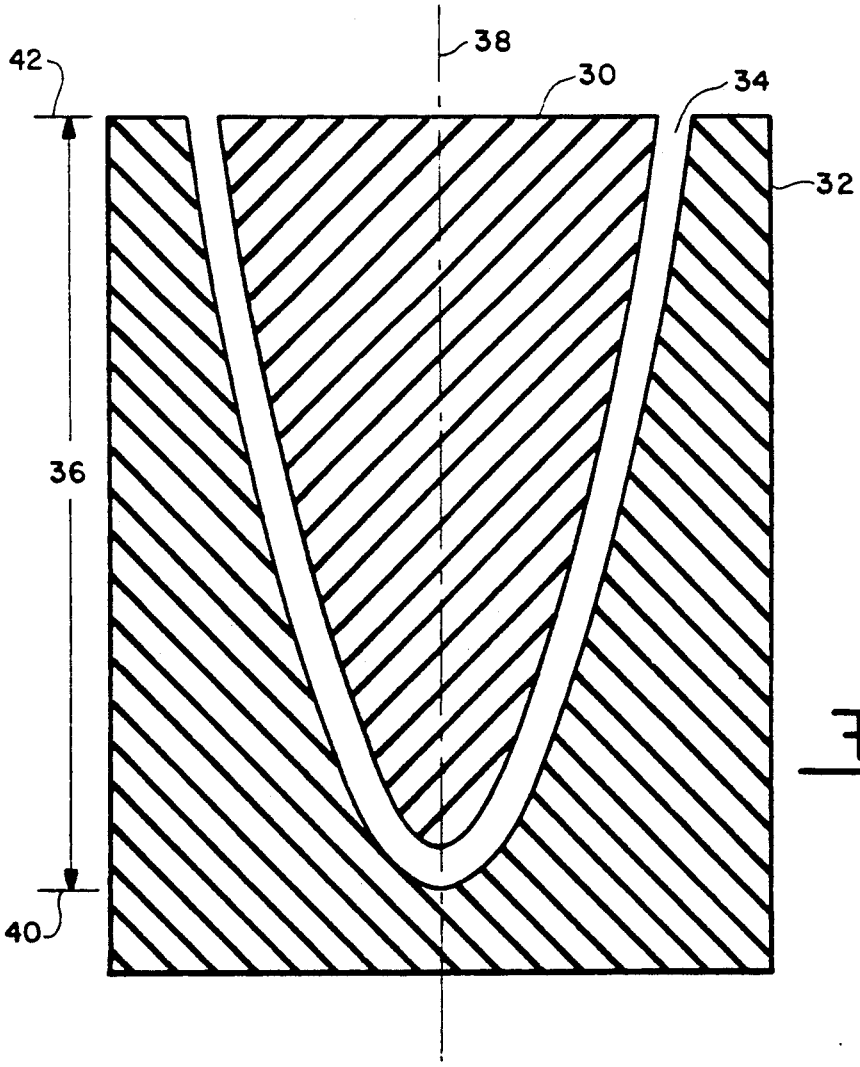
FIG. 2 is a cross-section of a two-part radome mold.

The nosecone 10 is manufactured by a series of steps which comprises, first, providing a nosecone mold such as that shown in FIG. 2. The mold comprises a male mold portion 30 which defines the inside of nosecone 10, and a female mold portion 32 which forms the outside of nosecone 10. The space 34 between mold portions 30 and 32 defines the nosecone.

Next, a series of formulations comprising particulate silicon, silicon nitride and a pore-forming material are prepared. The silicon powder is conventional material for such a use and preferably it has a particle size substantially less than 35 microns in diameter. The mixture can be a dry mixture or in the form of a slurry. While it is preferred that the silicon and silicon nitride be premixed and the pore-forming composition added, the three components can be simultaneously mixed.

The silicon nitride is preferably present in an amount (with respect to the silicon only) in the range of from 95:5 to 50:50 (silicon : silicon nitride). It is further preferred that the silicon nitride be present in the lower portion of the stated range.

For blending with the silicon particles, particles of numerous compositions are able to sublime without leaving a residue, including naphthalene, camphor and carbon dioxide, provided that the carbon dioxide is maintained under cryogenic conditions, are suitable. Preferably, naphthalene particles are blended with the silicon particles.

Preferably, about 25% to 80% by weight silicon and silicon nitride particles of sufficient fineness are blended by conventional means to coat the composition particles. At least about 25% by weight silicon and silicon nitride is needed to maintain a network of the desired shape after removal of the pore-forming composition particles that is capable of subsequently reacting with free nitrogen, to form a similar shaped α-silicon nitride whisker compact. If more than 80% by weight silicon and silicon nitride particles are used, however, the matrix remaining after removal of the pore-forming composition may be too dense to ensure complete nitriding of the silicon powder.

It is preferred that the composition particles be larger than the silicon and silicon nitride particles. Since silicon and silicon nitride powders and naphthalene powders have opposite electrostatic charges, the smaller silicon particles adhere to and coat the larger naphthalene particles.

A first one of these series of formulations is prepared so that the portion of the completed radome containing this formulation has a density of about 0.75 to 1.0 g/cc. A last one of these series of formulations is prepared to provide a final density of about 1.6 to 2.0 g/cc., and a plurality of formulations are prepared to provide final densities between those of the first and last of this series of formulations.

The first of the series of formulations is introduced and compacted into the mold cavity 34 in an amount sufficient to fill about 60 to 85% of the height 36 of the cavity 34. The height 36 of cavity 34 is defined as the distance along axis 38 from the forward end or bottom 40 of cavity 34 to the aft end or top 42 of cavity 34.

The next of the series of formulations is then introduced and compacted into the mold cavity 34 in an amount sufficient to fill about 1.5 to 5 percent of the height 36 of cavity 34. This step is repeated at least one time and up to 9 times, with each successive formulation providing a final density greater than the next preceding formulation.

The last one of the series of formulations is then introduced and then compacted into the remaining mold cavity space, providing about 15 to 25 percent of the height 36 of cavity 34.

The shaped compact is next removed from the mold and the pore-forming material is removed therefrom to leave an openly porous silicon/silicon nitride precursor compact that maintains the desired shape. For example, when naphthalene is used as the pore-former the compact is baked at a temperature below the melting temperature of naphthalene, i.e., 80°-83° C., preferably in a vacuum. Sublimation of the naphthalene leaves a porous skeletal compact of silicon and silicon nitride.

In accordance with the invention the porous shaped silicon-silicon nitride compact is reacted with a substance that releases free nitrogen. The reaction occurs at a temperature sufficiently high to convert the shaped silicon-silicon nitride to an identically shaped porous compact of α-silicon nitride whiskers but sufficiently low to avoid subliming substantially all of the formed whiskers.

Suitable reactive substances that release free nitrogen include nitrogen, dry ammonia, a mixture of hydrogen and dry ammonia, a mixture of nitrogen and dry ammonia, a mixture of hydrogen and nitrogen, and a mixture of nitrogen, dry ammonia and hydrogen. A preferred reactive substance is nitrogen containing from about 1 to 10 volume percent of a chemical selected from the group consisting of hydrogen and dry ammonia.

A preferred temperature range for reacting the silicon/ silicon nitride compact with nitrogen is about 1100° to 1490° C. The reaction of the silicon matrix with nitrogen is carried out long enough to completely transfor the silicon/silicon nitride compact to an identically shaped compact of α-silicon nitride whiskers.

Referring again to FIG. 1, the resulting nosecone may now be machined to a final configuration, including tapering the inside face of after portion 24 for bonding to transition section 14.

Although the invention has been described and illustrated with respect to making a shaped compact structure by filling a two-part mold from the forward end to the after end, it is within the scope of this invention to fill a mold from the after end toward the forward end.

Various modifications may be made in the above-described invention without departing from the spirit thereof, or the scope of the appended claims.

We claim:

1. A monolithic silicon nitride radome structure having a forward portion, an after portion and a transition portion therebetween, wherein said forward portion has a density of about 0.75 to 1.0 g/cc, said after portion has a density of about 1.6 to 2.0 g/cc and said transition portion consists of a plurality of regions from forward to aft, each region having increasing density between the densities of said forward and after portions.

2. The structure of claim 1 wherein said forward portion comprises about 60 to 85 percent, said after portion comprises about 15 to 25 percent and each of said regions comprises about 1.5 to 5 percent of the height of said structure.

3. The structure of claim 1 wherein said forward portion has a density of about 0.9 g/cc, wherein said transition portion consists of four regions having densities of about 1.0, 1.2, 1.4 and 1.6 g/cc. respectively from forward to aft, and wherein said after portion has a density of about 1.8 g/cc.

4. The structure of claim 1 wherein said transition portion consists of 2 to 10 regions of increasing density.

5. A method for manufacturing a silicon nitride radome structure having a forward portion having a density of about 0.75 to 1.0 g/cc, an after portion having density of about 1.6 to 2.0 g/cc and a transition portion consisting of a plurality of regions of increasing density from forward to aft between the densities of said forward and after portions, which comprises, in combination, the steps of:

(a) providing a radome mold having male and female mold portions, said mold portions defining a mold cavity;

(b) providing a series of formulations consisting essentially of particulate silicon, silicon nitride and a fugitive pore-forming material, wherein a first one of said formulations contains a first amount of said pore-forming material, a last one of said formulations contains a last amount of said pore-forming material and the series of said formulations between said first and last formulations contain amounts of said pore-forming material between said first and last amounts;

(c) filling and compacting about 50 to 75 percent of said mold cavity with said first formulation;

(d) filling and compacting about 1.5 to 5 percent of said mold cavity with a next one of said formulations, said next formulation containing less of said pore-forming material than the preceding formulation;

(e) repeating step (d) one to nine times;

(f) filling and compacting about 15 to 25 percent of said mold cavity with said last one of said formulations, said last formulation containing less of said pore-forming material than the preceding formulation;

(g) removing the resulting shaped compact from said mold;

(h) subliming said pore-forming material from said compact to form a porous compact structure; and (i) reacting said porous compact structure with a substance that releases free nitrogen at a temperature sufficiently high to convert said porous compact structure to an identically shaped radome structure of α-silicon nitride whiskers but sufficiently low to avoid subliming substantially all of said whiskers which are formed.

6. The method of claim 5 wherein said pore-forming material is naphthalene.

7. The method of claim 5 wherein said pore-forming material is camphor.

8. The method of claim 5 wherein said pore-forming material is solid carbon dioxide.

9. The method of claim 5 wherein said formulations contain about 25 to 80 weight percent of silicon and silicon nitride with the remainder being said pore-forming material, wherein the weight ratio of silicon to silicon nitride is about 95:5 to 50:50.

10. The method of claim 5 wherein said first formulation is prepared so that the forward portion of said radome containing this formulation has a density of about 0.75 to 1.0 g/cc, wherein said last formulation is prepared so that the after portion of said radome containing this formulation has a density of about 1.6 to 2.0 g/cc, and wherein said formulations between said first and said last formulations are prepared so that the portion of said radome between said forward portion and said after portion has a variable density ranging from forward to aft, between the density of said forward portion and said after portion.

11. A method for manufacturing a silicon nitride radome structure having a forward portion having a density of about 0.75 to 1.0 g/cc, an after portion having density of about 1.6 to 2.0 g/cc, and a transition portion consisting of a plurality of bands of increasing density from forward to aft between the densities of said forward and after portions, which comprises, in combination, the steps of:

(a) providing a radome mold having male and female mold portions, said mold portions defining a mold cavity;

(b) providing a series of formulations consisting essentially of particulate silicon, silicon nitride and a fugitive pore-forming material, wherein a first one of said formulations contains a first amount of said pore-forming material, a last one of said formulations contains a last amount of said pore-forming material and the series of said formulations between said first and last formulations contain amounts of said pore-forming material between said first and last amounts;

(c) filling and compacting about 15 to 25 percent of said mold cavity with said first formulation;

(d) filling and compacting about 1.5 to 5 percent of said mold cavity with a next one of said formulations, said next formulation containing more of said pore-forming material than the preceding formulation;

(e) repeating step (d) one to nine times;

(f) filling and compacting about 50 to 75 percent of said mold cavity with said last one of said formulations, said last formulation containing more of said pore-forming material than the preceding formulation;

(g) removing the resulting shaped compact from said mold;

(h) subliming said pore-forming material from said compact to form a porous compact structure; and (i) reacting said porous compact structure with a substance that releases free nitrogen at a temperature sufficiently high to convert said porous compact structure to an identically shaped radome structure of α-silicon nitride whiskers but sufficiently low to avoid subliming substantially all of said whiskers which are formed.

12. The method of claim 11 wherein said pore-forming material is naphthalene.

13. The method of claim 11 wherein said pore-forming material is camphor.

14. The method of claim 11 wherein said pore-forming material is solid carbon dioxide.

15. The method of claim 11 wherein said formulations contain about 25 to 80 weight percent of silicon and silicon nitride with the remainder being said pore-forming material, wherein the weight ratio of silicon to silicon nitride is about 95:5 to 50:50.

16. The method of claim 11 wherein said first formulation is prepared so that the after portion of said radome containing this formulation has a density of about 1.6 to 2.0 g/cc, wherein said last formulation is prepared so that the forward portion of said radome containing this formulation has a density of about 0.75 to 1.0 g/cc, and wherein said formulations between said first and said last formulations are prepared so that the portion of said radome between said forward portion and said after portion has a variable density ranging from aft to forward, between the density of said after portion and said forward portion.

* * * * *